US006848986B2

(12) United States Patent
Kendall et al.

(10) Patent No.: US 6,848,986 B2
(45) Date of Patent: Feb. 1, 2005

(54) DUAL CURED ABRASIVE ARTICLES

(75) Inventors: Philip E. Kendall, Woodbury, MN (US); Soon C. Park, Woodbury, MN (US); Wesley J. Bruxvoort, Woodbury, MN (US); Scott R. Culler, Burnsville, MN (US); Jerry W. Williams, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/427,005

(22) Filed: Apr. 30, 2003

(65) Prior Publication Data

US 2003/0194961 A1 Oct. 16, 2003

Related U.S. Application Data

(63) Continuation of application No. 09/819,233, filed on Mar. 28, 2001, now abandoned.

(51) Int. Cl.[7] ..... B24B 7/22; B24D 3/28

(52) U.S. Cl. ..... 451/526; 451/41; 451/533; 51/295

(58) Field of Search ..... 451/526, 527, 451/533, 534, 539, 41; 51/295, 307, 308, 309

(56) References Cited

U.S. PATENT DOCUMENTS

| | | | | |
|---|---|---|---|---|
| 3,502,453 | A | | 3/1970 | Baratto |
| 4,156,035 | A | | 5/1979 | Tsao et al. |
| 4,227,978 | A | | 10/1980 | Barton |
| 4,311,489 | A | | 1/1982 | Kressner |
| 4,623,676 | A | | 11/1986 | Kistner |
| 4,668,601 | A | | 5/1987 | Kistner |
| 4,903,440 | A | | 2/1990 | Larson et al. |
| 5,041,468 | A | | 8/1991 | Budnik et al. |
| 5,055,113 | A | | 10/1991 | Larson et al. |
| 5,061,294 | A | | 10/1991 | Harmer et al. |
| 5,137,542 | A | | 8/1992 | Buchanan et al. |
| 5,152,917 | A | | 10/1992 | Pieper et al. |
| 5,203,884 | A | | 4/1993 | Buchanan et al. |
| 5,368,619 | A | | 11/1994 | Culler |
| 5,451,446 | A | | 9/1995 | Kincaid et al. |
| 5,453,312 | A | | 9/1995 | Haas et al. |
| 5,496,387 | A | | 3/1996 | Culler |
| 5,527,368 | A | | 6/1996 | Supkis et al. |
| 5,542,961 | A | | 8/1996 | Swei et al. |
| 5,571,297 | A | | 11/1996 | Swei et al. |
| 5,632,668 | A | | 5/1997 | Lindholm et al. |
| H1678 | H | | 9/1997 | Ronning |
| 5,672,097 | A | | 9/1997 | Hoopman |
| 5,681,361 | A | | 10/1997 | Sanders, Jr. |
| 5,681,612 | A | | 10/1997 | Benedict et al. |
| 5,700,302 | A | | 12/1997 | Stoetzel et al. |
| 5,704,952 | A | * | 1/1998 | Law et al. ..... 51/306 |
| 5,840,141 | A | | 11/1998 | Korbel |
| 5,855,632 | A | | 1/1999 | Stoetzel et al. |
| 5,908,477 | A | * | 6/1999 | Harmer et al. ..... 51/305 |
| 5,924,917 | A | | 7/1999 | Benedict et al. |
| 5,928,394 | A | | 7/1999 | Stoetzel |
| 5,942,015 | A | * | 8/1999 | Culler et al. ..... 51/295 |
| 5,954,844 | A | * | 9/1999 | Law et al. ..... 51/306 |
| 5,958,794 | A | * | 9/1999 | Bruxvoort et al. ..... 438/692 |
| 6,048,375 | A | | 4/2000 | Yang et al. |
| 6,066,188 | A | | 5/2000 | Benedict et al. |
| 6,077,601 | A | | 6/2000 | DeVoe et al. |
| 6,120,878 | A | | 9/2000 | Follensbee et al. |
| 6,139,594 | A | | 10/2000 | Kincaid et al. |
| 6,162,522 | A | | 12/2000 | Deka et al. |
| 6,187,070 | B1 | | 2/2001 | Gaeta et al. |
| 6,217,413 | B1 | | 4/2001 | Christianson |
| 6,217,432 | B1 | * | 4/2001 | Woo ..... 451/534 |
| 6,231,629 | B1 | * | 5/2001 | Christianson et al. ..... 51/295 |
| 6,354,929 | B1 | * | 3/2002 | Adefris et al. ..... 451/527 |
| 6,406,577 | B1 | | 6/2002 | Benedict et al. |
| 6,458,018 | B1 | * | 10/2002 | Goers et al. ..... 451/41 |
| 2002/0026752 | A1 | * | 3/2002 | Culler et al. ..... 51/298 |

FOREIGN PATENT DOCUMENTS

| | | |
|---|---|---|
| WO | WO 93/12911 | 7/1993 |
| WO | WO 95/09724 | 4/1995 |
| WO | WO 98/39142 | 9/1998 |
| WO | WO 00/15390 | 3/2000 |
| WO | WO 00/37569 | 6/2000 |
| WO | WO 00/58930 | 10/2000 |

OTHER PUBLICATIONS

Odian, "Chain Transfer", *Principles of Polymerization*, John Wiley & Sons, New York, 1991, pp. 243–255.

Peeters, "Overview of Dual–Cure and Hybrid–Cure Systems in Radiation Curing" *Radiation Curing In Polymer Science and Technology, vol. III, Polymerization Mechanisms*, Fouassier and Rabek eds., Elsevier Applied Science, N.Y., Chapter 6, pp. 177–217 (1993).

* cited by examiner

*Primary Examiner*—David B. Thomas
(74) *Attorney, Agent, or Firm*—Colene H. Blank

(57) ABSTRACT

The present invention is directed to a method of making a three-dimensional fixed abrasive article, and a three dimensional fixed abrasive made thereby. The method comprises providing an abrasive composition comprising a plurality of abrasive particles and a binder precursor. The binder precursor comprises a polymerizable material consisting essentially of an ethylenically unsaturated material having one or more terminal functional groups of the same type of reactive functionality, a photoinitiator, and a thermal initiator. The abrasive composition is then applied onto a backing. The method then comprises at least partially curing the binder precursor by activating the photoinitiator, and further curing the binder precursor by activating the thermal initiator to provide a three-dimensional fixed abrasive.

10 Claims, No Drawings

DUAL CURED ABRASIVE ARTICLES

CROSS REFERENCE TO RELATED APPLICATIONS

This application is a continuation of U.S. patent application Ser. No. 09/819,233, filed Mar. 28, 2001, now abandoned, the disclosure of which is herein incorporated by reference.

BACKGROUND OF THE INVENTION

The invention relates to an abrasive article, and a method of making and using the abrasive article. Abrasive articles have been utilized to abrade and finish workpiece surfaces for well over a hundred years. These applications have ranged from high stock removal, and high pressure metal grinding processes to fine polishing of ophthalmic lenses and primed surfaces. In general, abrasive articles comprise a plurality of abrasive particles bonded either together (e.g., a bonded abrasive or grinding wheel) or to a backing (e.g., a coated abrasive). For a coated abrasive there is typically a single, or sometimes two layers of abrasive particles. Once these abrasive particles are worn, the coated abrasive is essentially worn out and is typically discarded.

One way to extend the life of a coated abrasive has been to use a three-dimensional coating. A three-dimensional coating of abrasive particles is exemplified in U.S. Pat. No. 5,152,917 (Pieper et al.). Pieper reports a three-dimensional structured abrasive that results in a relatively high rate of cut and a relatively fine surface finish on the workpiece surface. The abrasive comprises non-random, precisely shaped abrasive composites that are bonded to a backing.

One method of providing a three-dimensional, textured, fixed abrasive article is generally as follows. A slurry containing a mixture of a binder precursor and a plurality of abrasive particles is coated onto a production tool having cavities that are the negative of the desired shape of the textured surface. A backing is brought into contact with the exposed, coated surface of the production tool such that the slurry wets the surface of the backing. Then, the binder may be first at least partially solidified, cured, or gelled. The abrasive article is then removed from the production tool and subsequently fully cured if it was not fully cured in the previous first cure. Alternatively, the slurry may be applied onto the surface of the backing and then the production tool may be brought into contact with the slurry coated on the backing. The abrasive layer thus comprises a plurality of abrasive "composites" on a backing.

A two-step curing process comprising a first partial cure and a subsequent full cure is known as a dual cure process. In a dual cure system, the polymerization or crosslinking of the binder precursor occurs in two separate stages, via either the same or different reaction mechanisms. Traditionally, chemical curing mechanisms that may occur in these systems include radical polymerization of acrylic double bonds, radical polymerization of unsaturated polyesters, styrene or other monomers, and cationic curing of vinyl ethers or epoxies. The dual-cure systems may combine radiation curing with thermal curing, or radiation curing with moisture curing, for example. Combining curing mechanisms has been accomplished in the past, for example, by mixing materials with two types of functionality on one structure or by mixing different materials having one type of functionality. Such systems are discussed in Peeters, "Overview of Dual-Cure and Hybrid-Cure Systems in Radiation Curing," Radiation Curing in Polymer Science and Technology: Volume III Polymer Mechanisms, Fouassier and Rabek, eds., Elsevier Applied Science, NY, Chapter 6, 177–217 (1993).

However, using past dual cure systems may lead to inconsistent cure throughout the thickness of a three-dimensional abrasive article. A major concern in the manufacture of abrasive articles is product consistency.

SUMMARY

The present invention is directed to a method of making a three-dimensional fixed abrasive article. The method comprises providing an abrasive composition comprising a plurality of abrasive particles and a binder precursor. The binder precursor comprises a polymerizable material consisting essentially of an ethylenically unsaturated material having one or more terminal functional groups of the same type of reactive functionality, a photoinitiator, and a thermal initiator. The abrasive composition is then applied onto a backing. The method then comprises at least partially curing the binder precursor by activating the photoinitiator, and further curing the binder precursor by activating the thermal initiator to provide a three-dimensional fixed abrasive.

The invention is additionally directed to an abrasive article comprising a backing comprising a surface and an abrasive layer bonded to the surface of the backing. The abrasive layer comprises a cross-linked binder and a plurality of abrasive particles, the cross-linked binder being cross-linked by an ethylenically unsaturated material having one or more terminal functional groups of the same type of reactive functionality, a photoinitiator, and a thermal initiator, the abrasive layer comprising a plurality of three-dimensional abrasive composites.

For the purpose of the present invention:

A "fixed" abrasive article is an abrasive article that is substantially free of unattached abrasive particles except as may be generated during use.

A "three-dimensional" abrasive article is an abrasive article generally formed from an abrasive composition slurry having numerous abrasive particles extending throughout at least a portion of the thickness of an abrasive layer such that removing some of the abrasive layer during use exposes additional abrasive particles.

A "textured" abrasive article is an abrasive article having raised portions and recessed portions in which at least the raised portions contain abrasive particles and binder.

An "erodible" abrasive article is an abrasive article that breaks down under use conditions in a controlled manner.

An "abrasive composite" refers to one of a plurality of shaped bodies, which collectively provide a textured, three-dimensional abrasive article comprising abrasive particles and a binder. The abrasive particles may be in the form of abrasive agglomerates.

A "structured abrasive composite" refers to an abrasive composite having a molded shape that is the inverse of the mold cavity, which is retained after the composite has been removed from the mold. The composite may be substantially free of abrasive particles protruding beyond the exposed surface of the shape before the abrasive article has been used, as reported in U.S. Pat. No. 5,152,917 (Pieper et al.), incorporated herein by reference.

"Consistently cured" means that, throughout the thickness and along the web of the abrasive article, the binder has either no, or a uniform amount of unreacted terminal functional groups. A consistently cured article may be evidenced by removing a consistent amount (by percentage) of unreacted monomers for any thickness of abrasive layer using the Tetrahydrofuran Soxhlet Extraction test.

DETAILED DESCRIPTION OF THE INVENTION

The present invention provides a three-dimensional fixed abrasive article having a consistent cure throughout the thickness of the abrasive layer. This provides an erodible abrasive article throughout the worklife.

Abrasive Article

In general, abrasive particles are dispersed in a binder precursor to form an abrasive layer and/or abrasive composites bonded to a backing. The abrasive article comprises a backing having a front surface. The abrasive layer is attached on the front surface of the backing. The abrasive layer is three-dimensional and comprises a plurality of abrasive composites. In some embodiments, abrasive composites are shaped as pyramids. There are recesses or valleys between adjacent abrasive composites. There may be more than one row of pyramidal abrasive composites, and the second row of abrasive composites may be offset from the first row. The abrasive composites comprise a plurality of abrasive particles dispersed in a binder. Optionally, the abrasive article does not have to have a separate backing.

In some embodiments, the abrasive article is erodible, i.e., able to wear away controllably with use. Erodibility is desired because it results in the worn or used abrasive particles being expunged from the abrasive article to expose unused abrasive particles. In certain embodiments, the abrasive article is consistently erodible throughout the worklife of the abrasive article. Since the abrasive article is three-dimensional, a plentiful supply of unused abrasive particles will thus be assured. If the abrasive layer is not erodible, the worn or used abrasive particles may not properly be discharged from the abrasive article, in which case fresh abrasive particles might not be exposed. If the abrasive layer is too erodible, abrasive particles may be expelled too fast, which may result in an abrasive article with shorter than desired product life.

The degree of erodibility is also a function of the surface texture, the abrasive layer composition, the use conditions and the workpiece. There are many ways of endowing an abrasive product with credibility. Some abrasive products enhance erodibility with the addition of water soluble or water swellable particles. The particle may be organic or inorganic. These additives may be used in embodiments involving abrasion in the presence of an aqueous solution. Additionally, addition of a water soluble or a water swellable particle throughout the thickness of the abrasive article allows for a uniform erodibility throughout the thickness of the abrasive article.

Certain modifications may be made in the three-dimensional, textured, fixed abrasive article to improve or otherwise alter performance. For example, the abrasive article may be perforated to provide openings through the abrasive layer and/or the backing to permit the passage of fluids before, during or after use.

1. Backing

The abrasive article may comprise a backing provided with an abrasive layer. In some embodiments, the backings are uniform in thickness. Any of a variety of backing materials are suitable for this purpose, including both flexible backings and rigid backings. Examples of typical flexible abrasive backings include polymeric film, primed polymeric film, metal foil, cloth, paper, vulcanized fiber, nonwovens and treated versions thereof and combinations thereof. One type of backing is a polymeric film. Examples of such films include polyester films, polyester and co-polyester films, microvoided polyester films, polyimide films, polyamide films, polyvinyl alcohol films, polypropylene film, polyethylene film, and the like. The thickness of the polymeric film backing generally ranges between about 20 to 1000 micrometers, and in some embodiments ranges between about 50 and about 500 micrometers. In certain embodiments, the polymeric film thickness ranged between about 60 and about 200 micrometers. There should also be good adhesion between the polymeric film backing and the abrasive layer. In many instances, the coating surface of polymeric film backing is primed to improve adhesion. The primer may involve surface alteration or application of a chemical-type primer. Examples of surface alterations include corona treatment, UV treatment, electron beam treatment, flame treatment and scuffing to increase the surface area.

Examples of suitable rigid backings include metal plates, ceramic plates, and the like. Other backings may also consist of two or more backings laminated together, or comprise reinforcing fibers engulfed in a polymeric material as reported in PCT publication WO 93/12911 (Benedict et al.). Additionally, a pressure sensitive adhesive or other means of attaching the abrasive to a tool (e.g., hook and loop) may be laminated to a nonabrasive side of the backing.

Other suitable backings are embossed polymeric films (e.g., a polyester, polyurethane, polycarbonate, polyamide, polypropylene, or polyethylene film) or embossed cellulosic backings (e.g., paper or other nonwoven cellulosic material). The embossed material may also be laminated to a non-embossed material to form the backing. The embossed pattern may be any texture. For example, the pattern may be in the form of an hexagonal array, ridges, lattices, pyramids, truncated pyramids, cones, cubes, blocks, rods, and the like. The backing may also be a foamed backing, e.g., a polymeric foam such as a polyurethane foam, and a foam substrate may be laminated to the backing.

The backing may also contain a treatment to modify its physical properties. These treatment coats are well known in the abrasive art and include acrylate-based presize coats, phenolic presize coats and phenolic/latex presize coats.

In some instances, the back side or back surface of the backing may contain a friction coating. This friction coating may comprise a plurality of friction particles bonded to the backing by means of a friction coating binder. Friction particles may be any suitable material to create the desired coefficient of friction. Examples of suitable friction particles include both inorganic particles and organic particles, e.g., abrasive particles and/or filler particles. Alternatively, the friction coating may comprise a coating such as a urethane coating.

2. Abrasive Particles

The abrasive article comprises abrasive particles and a binder. The abrasive particles may be homogeneously dispersed in the binder or alternatively the abrasive particles may be non-homogeneously dispersed. In some embodiments, the abrasive particles may be homogeneously dispersed.

The average particle size of the abrasive particles may range from between about 0.001 and about 300 micrometers. Some embodiments may contain abrasive particle between about 0.01 and about 250 micrometers, specifically between about 0.02 and about 100 micrometers. The particle size of the abrasive particle is typically measured by the longest dimension of the abrasive particle. In almost all cases there will be a range or distribution of particle sizes. In some instances, the particle size distribution may be tightly controlled such that the resulting abrasive article provides a very consistent surface finish.

In some embodiments, the abrasive article is used in the presence of a liquid medium, such as an aqueous fluid. The abrasive particles may be resistant to the liquid medium such that their physical properties do not substantially degrade upon exposure to the liquid medium. Suitable abrasive particles are typically inorganic abrasive particles. The inorganic abrasive particles may further be categorized as "hard" inorganic abrasive particles (i.e., those having a Mohs hardness of 8 or greater) and "soft" inorganic abrasive particles (i.e., those having a Mohs hardness less than 8).

Examples of suitable abrasive particles include fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles and the like. The alumina abrasive particles may contain a metal oxide modifier. The diamond and cubic boron nitride abrasive particles may be mono crystalline or polycrystal line.

Other examples of suitable inorganic abrasive particles include silica, iron oxide, chromia, ceria, zirconia, titania, tin oxide, gamma alumina, and the like. Such particles, when properly incorporated into an abrasive article, provide the desired rate of cut and the desired surface finish on a workpiece during use. Selection of the appropriate abrasive particle is based on the required use of the abrasive article.

The abrasive article may also contain a mixture of two or more different types of abrasive particles. This mixture may comprise a mixture of "hard" inorganic abrasive particles and "soft" inorganic abrasive particles, or a mixture of two "soft" abrasive particles. In the mixture of two or more different abrasive particles, the individual abrasive particles may have the same average particle size, or may have a different average particle size.

The abrasive particles may also have a shape associated with it. Examples of such shapes include rods, triangles, pyramids, cones, solid spheres, hollow spheres and the like. Alternatively, the abrasive particle may be randomly shaped, e.g., like blocks or needles. In some instances, the surface of the abrasive particles is modified. The surface of the abrasive particle may be modified with additives or by other means, such as thermal treatment. These modified surfaces may improve the dispersibility of the abrasive particles in the binder precursor and/or improve the adhesion to the binder precursor and/or the binder. Surface treatment may also alter and improve the cutting characteristics of the modified abrasive particles. Surface treatment may also substantially lower the viscosity of the slurry used to prepare the abrasive article, thereby providing an easier manufacturing process. The lower viscosity also permits higher percentages of abrasive particles to be incorporated into a slurry. A surface treatment may minimize the agglomeration of the abrasive particles during the manufacture of the abrasive article.

The abrasive particles may be treated with a surface treatment additive in an amount up to about 25% by weight based solely upon the abrasive particle weight. The abrasive particles are treated with a surface treatment, this amount ranges from about 0.1% to about 10% by weight based solely upon the abrasive particle weight.

Examples of suitable surface modification additives include wetting agents, surfactants, dispersants, or adhesion modifiers, such as coupling agents. A coupling agent may provide an association bridge between the binder and the abrasive particles. The coupling agent may also provide an association bridge between the binder and the filler particles (to the extent present). Examples of suitable coupling agents include silanes, titanates, and zircoaluminates.

Surfactants may also be used as an additive. Examples of surfactants include metal alkoxides, polyalkylene oxides, salts of long chain fatty acids and the like. The surfactants may be cationic, anionic, amphoteric, or nonionic as long as the surfactant is compatible with both the abrasive particle and the binder precursor. In some instances, surface treatment is applied by the abrasive particle manufacturer during the manufacturing process of the abrasive particle. For example, a surface treatment may be applied during the crushing and/or screening/classifying process to make the abrasive particles.

The abrasive particles may contain a surface coating to alter the abrading characteristics of the resulting abrasive grain. The abrasive particles may also contain multiple additives.

3. Filler Particles

The abrasive article may optionally further comprise filler particles. The filler may alter the erodibility of the abrasive article. In some instances with the appropriate filler and amount, the filler may decrease the erodibility of the abrasive article. Conversely, in some instances with the appropriate filler, the filler may increase the erodibility of the abrasive article. Fillers may also be selected to reduce cost of the abrasive article, alter the rheology of the slurry, and/or to alter the abrading characteristics of the abrasive article.

A filler is a particulate material that does not abrade the workpiece to any significant extent; thus, whether a material qualifies as a "filler" might depend upon the particular workpiece surface being treated. It is possible for a material to act as a filler in the context of one workpiece and as an abrasive particle in the context of a different workpiece.

Filler particles generally have an average particle size range between about 0.5 and about 500 micrometers. In some embodiments, the filler particle is between about 5 and about 20 micrometers. In addition, the filler typically has a Mohs hardness less than 5, in some embodiments less than 4, and in certain embodiments less than about 3, although fillers outside of this hardness range may also be used. Examples of suitable fillers include: metal carbonates (such as calcium carbonate (chalk, calcite, marl, travertine, marble and limestone)), calcium magnesium carbonate, sodium carbonate, magnesium carbonate), silica (such as quartz, glass beads, glass bubbles and glass fibers) silicates (such as talc, clays such as (montmorillonite), feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, certain metal oxides (such as calcium oxide (lime)), alumina, tin oxide (e.g. stannic oxide), titanium dioxide, metal sulfites (such as calcium sulfite), thermoplastic particles (e.g., polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles, phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins, and the like). The filler may also be a salt such as a halide salt. Examples of halide salts include sodium chloride, potassium cryolite, sodium cryolite, ammonium cryolite, potassium tetrafluoroboate, sodium tetrafluoroborate, silicon fluorides, potassium chloride, and magnesium chloride. Examples of metal fillers include tin, lead, bismuth, cobalt, antimony, cadmium, iron, and titanium. Other miscellaneous fillers include sulfur, organic sulfur compounds, graphite, boron nitride, and metallic sulfides. The above mentioned examples of fillers are meant to be a representative showing of some useful fillers, and are not meant to encompass all useful fillers. Other useful fillers include calcium carbonate, and silicates such as magnesium silicate, aluminum silicate, and calcium silicate.

In certain embodiments, a filler that is not soluble in the binder precursor, but is soluble in a liquid such as an aqueous solution is incorporated in the abrasive article. The filler may be a water soluble inorganic or organic particle, such as an organic salt or a soluble polymer particle. Such a filler may be, for example, sugar, dextrose, a soluble salt such as a halide salt, polyvinyl acetate, cellulosic based particles, polyvinyl alcohol, or methocel. The water soluble particle may chosen based on the intended use of the abrasive article. Water soluble fillers are especially useful in aqueous fluid grinding systems. During use, the water soluble filler may dissolve, creating pores in the abrasive article at the surface. The aqueous solution, in addition to dissolving the water soluble filler, also washes away any eroded abrasive particles. The average particle size of the water soluble filler particles may range between about 0.05 and about 500 micrometers, in some embodiments between about 1 to 100 micrometers. The fillers may be mixed into the abrasive article at between about 0.5 and about 70 percent by weight of the abrasive article, in some embodiments between about 1 and about 30 percent by weight. In further embodiments, the fillers may be loaded into the abrasive article at between about 3 and about 20 percent by weight.

The fillers may be provided with a surface treatment as described above in the case of the abrasive particles. An example of a surfactant for calcium carbonate filler particles is "LP1" commercially available from ICI Chemical Inc.

4. Binders

Organic Materials

In some embodiments, the binders for the abrasive articles of this invention may be formed from an organic binder precursor. The binder precursor comprises an ethylenicaly unsaturated material having one or more terminal functional groups of the same type of functionality (e.g. all acrylate functionalities.) The binder precursor has a phase that is capable of flowing sufficiently so as to be coatable, and then solidifying. The solidification may be achieved by curing (e.g., polymerizing and/or crosslinking) in a two-step process. The precursor may be an organic solvent-borne, waterborne, or 100% solids (i.e., a substantially solvent-free) composition. Both thermoplastic and thermosetting materials, as well as combinations thereof, may be used as the binder precursor.

In many instances, the abrasive layer is formed from an abrasive composition that comprises a mixture of abrasive particles and a binder precursor. The abrasive layer generally may comprise by weight between about 1 part and about 90 parts abrasive particles and between about 10 parts to about 99 parts binder, depending on the abrasive particle density. For example, the abrasive layer may comprise about 40 to about 95 parts by weight abrasive particles and about 60 to about 5 parts by weight binder. In some embodiments, the abrasive layer comprises about 50 to about 90 parts by weight abrasive particles and about 50 to about 10 parts by weight binder precursor.

The binder precursor may be a curable organic material having an ethylenicaly unsaturated material having one or more terminal functional groups of the same type of functionality (i.e., a material capable of polymerizing and/or crosslinking upon exposure to heat and/or other sources of energy, such as E-beam, ultraviolet, visible, etc., or with time upon the addition of a chemical catalyst, moisture, and the like). Binder precursor examples include (meth)acrylate monomers, oligomers, polymers or mixtures thereofs (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, reactive vinyl resins, and the like. In specific embodiments, the binder precursor is an ethylenically unsaturated monomers or oligomers.

The ethylenically unsaturated monomers or oligomers have one or more terminal functional groups of the same type of functionality, and include both acrylate and methacrylate-based monomers (collectively (meth)acrylate). Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Suitable ethylenically unsaturated compounds may have a molecular weight of less than about 4,000 and in some embodiments are esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl)isocyanurate, 1,3,5-tri(2-methyacryloxyethyl)-s-triazine, acrylamide, methylacrylamide, N-methylacrylamide, N,N-dimethylacrylamide, N-vinyl-pyrrolidone, and N-vinyl-piperidone.

Specific examples of suitable mono-functional acrylates and methacrylates that may be used include lauryl acrylate, octyl acrylate, 2(2-ethoxyethoxy) ethylacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, and, polypropylene glycol monoacrylate.

In some embodiments, the abrasive article may provide a substantially consistent cut rate throughout the life of the abrasive article. If the binder precursor is not consistently cured, the binder tends to migrate to the outer surface of the abrasive layer, resulting essentially in a film of binder on the outer surface of the abrasive article. The binder film may interfere with the initial cutting ability of the abrasive article.

The following discussion relates to materials that may be added to the organic monomers, oligomers, polymers or mixtures thereof in preparing the binder.

Plasticizer

The abrasive layer may optionally include a plasticizer. In general, the addition of the plasticizer might increase the erodibility of the abrasive article and lessen the overall binder hardness. In some instances, the plasticizer might act as a diluent for the binder precursor. The plasticizer may be compatible with the binder to minimize phase separation. Examples of suitable plasticizers include polyethylene glycol, polyvinyl chloride, dibutyl phthalate, alkyl benzyl phthalate, polyvinyl acetate, polyvinyl alcohol, cellulose esters, phthalate, silicone oils (e.g., as reported in U.S. Pat. No. 5,453,312 (Haas et al.)), adipate and sebacate esters, polyols, polyols derivatives, t-butylphenyl diphenyl phosphate, tricresyl phosphate, castor oil, combinations thereof and the like. In some embodiments, the plasticizers are phthalate derivatives.

Initiator

The binder precursor is cured with the aid of both a photoinitiator and a thermal initiator acting on the same functional type. Examples of initiators include organic peroxides (e.g., benzoil peroxide), azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Examples of suitable commercially available, ultraviolet-activated photoinitiators are sold under the trade designations IRGACURE 651, IRGACURE 184, IRGACURE 369 and IRGACURE 819, all commercially available from the Ciba Geigy Company, Lucirin TPO-L, commercially available from BASF Corp. and DAROCUR 1173 commercially available from Merck & Co. Examples of suitable thermal initiators are sold under the trade designations VAZO 52, VAZO 64 and VAZO 67 azo compound thermal initiators, all commercially available from E.I. duPont deNemours and Co.

In the case of photopolymerizations, the initiator system may include a photosensitizer as well. Examples of photosensitizers include compounds having carbonyl groups or tertiary amino groups and mixtures thereof. Examples of compounds having carbonyl groups are benzophenone, acetophenone, benzil, benzaldehyde, o-chlorobenzaldehyde, xanthone, thioxanthone, 9,10-anthraquinone, and other aromatic ketones. Examples of tertiary amines are methyldiethanolamine, ethyldiethanolamine, triethanolamine, phenylmethyl-ethanolamine, and dimethylaminoethylbenzoate. In general, the amount of photosensitizer or photoinitiator system may vary from about 0.01 to 10% by weight, for example from 0.25 to 4.0% by weight, based on the weight of the monomer, oligomer, polymer or combination component of the binder precursor.

Typically, the total amount of initiator (both photoinitiator and thermal initiator) is used in amounts ranging from 0.1 to 10% by weight, based on the weight of the monomer, oligomer, polymer or combination component of the binder precursor, for example about 1 to about 5% by weight. Generally, the ratio of photoinitiator to thermal initiator is between about 3.5:1 and about 1:1. Additionally, the initiator may be dispersed, in some embodiments uniformly dispersed in the binder precursor prior to the addition of any particulate material, such as the abrasive particles and/or filler particles.

Other Additives

The binder precursor may further comprise additives such as abrasive particle surface modification additives, coupling agents, fillers, expanding agents, fibers, anti-static agents, initiators, suspending agents, lubricants, wetting agents, surfactants, pigments, dyes, UV stabilizers, complexing agents, chain transfer agents, accelerators, catalysts, and activators. The amounts of these additives are selected to provide the properties desired.

Expanding agents may be included to increase the erodibility of the abrasive article. The expanding agent may be any material that increases the volume of the abrasive layer. When an expanding agent is employed, the average particle size of the abrasive particles may be less than 30 micrometers. Examples of suitable expanding agents include steam, swelling solvents, nitrogen gas, carbon dioxide gas, air as a gas, pentane, hexane, heptane, butene, $CFCl_3$, $C_2F_3Cl_3$, vermiculite, toluene diisocyanate, 4,4'-diphenylmethane diisocyanate, hexamethylene diisocyanate, or polyurethane prepolymer which reacted with water to generate carbon dioxide gas. Other suitable expanding agents include a decomposition-type expanding agent such as ammonium carbonate, ammonium bicarbonate, sodium bicarbonate, dinitropentamethylenetetramine, azodicarbonamide, azobisisobutylonitrile, hydradine compounds such as maleic acid hydrazide, oxalic acid hydrazide, benzenesulfonyl hydrazide, toluenesulfonyl hydrazide, p,p'-hydroxy bis (benzene-sulfonyl hydrazide), and t-alkylhydrazonium salt. Two or more expanding agents may be used in combination with each other.

Examples of antistatic agents include graphite, carbon black, vanadium oxide, conductive polymers, humectants, and the like. These antistatic agents are reported in U.S. Pat. Nos. 5,061,294; 5,137,542; and 5,203,884, incorporated herein by reference.

An example of a suspending agent is an amorphous silica particle having a surface area less than 150 meters square/gram that is commercially available from DeGussa Corp. under the trade name "OX-50". The addition of the suspending agent may lower the overall viscosity of the slurry. The use of suspending agents is reported in U.S. Pat. No. 5,368,619 (Culler), incorporated herein by reference.

Examples of suitable lubricants include metal salts of fatty acids (e.g., zinc stearate, calcium stearate, and lithium stearate), graphite, waxes, glycol ethers, glycerine, silicone compounds, combinations thereof and the like. Encapsulated lubricants may also be used, e.g., as reported in U.S. Pat. No. 3,502,453 (Baratto) incorporated herein by reference.

Examples of chain transfer agents include carbon tetrabromide and other chain transfer agents reported in "Principles of Polymerization" by G. Odian, Wiley-Interscience, New York, 1991.

Examples of suitable complexing agents (particularly in the case of silicon dioxide-containing wafer surfaces) include ammonium salts such as $NH_4$ $HCO_3$, tannic acid, catechol, $Ce(OH)(NO)_3$; $Ce(SO_4)_2$, phthalic acid, salicyclic acid and the like. These complexing agents may be in the form of particulates that may be added to the slurry.

5. Abrasive Article Configuration

One abrasive article features a plurality of abrasive composites. These abrasive composites may be precisely shaped or irregularly shaped. Such a precise shape is formed, for example, by curing the binder precursor in the slurry while the slurry is both being formed on a backing and filling a cavity on the surface of a production tool, as described in greater detail, below.

The abrasive composite shape may be any shape. Typically the surface area of the base side of the shape that is in contact with the backing is larger in value than that of the distal end of the composite spaced from the backing. The shape of the composite may be selected from among a number of geometric shapes such as a cubic, cylindrical, prismatic, rectangular, pyramidal, truncated pyramidal, conical, truncated conical, cross, and post-like with a top surface which is flat. Another shape is hemispherical. The resulting abrasive article may have a mixture of different abrasive composite shapes. The abrasive composites may be arranged in rows, spiral, helix, corkscrew, or lattice fashion, or may be randomly placed.

The sides forming the abrasive composites may be perpendicular relative to the backing or they may be tapered with diminishing width toward the distal end. If the sides are tapered, it is easier to remove the abrasive composite from the cavities of the production tool. The angle forming the taper may range from about 1 to 75 degrees, for example from about 2 to about 50 degrees. In some embodiments, the angle is between about 3 to about 35 degrees, for example between about 5 to about 15 degrees. In certain embodiments, the lower angles tend to result in a more uniform cross sectional area along the height of the abrasive composite. The constant cross sectional area may provide a more consistent abrasive layer surface area during use. This in turn leads to a more consistent cut rate, flatness and surface finish.

The height of each composite in the same abrasive article may be the same, but it is possible to have composites of varying heights. Because of the curing system, even heights of up to 1000 micrometers may be consistently cured. Particularly, the height of the abrasive composites may range between about 25 to about 400 micrometers. The diameter or cross sectional width of the abrasive composite may be as wide as 3000 micrometers, and in some embodiments is between about 10 to about 2000 micrometers, for example between 15 to 1500 micrometers.

In any of the abrasive articles described herein, all of the abrasive composites may have essentially the same shape and size, but the orientation of individual abrasive composites may be different from one another relative to a reference point. If the abrasive article contains a backing, then the reference point may be a plane that is tangent to a point on the side of the backing. One potential advantage of rotating the abrasive composite relative to an adjacent abrasive composite is to increase the packing density of abrasive composites that have a certain shape. In some embodiments, an adjacent abrasive composite is rotated between 5 to 355 degrees, relative to its nearest neighbor. In those embodiments in which adjacent composites are rotated relative to one another, an adjacent abrasive composite is typically rotated between 30 to 120 degrees. In one embodiment, adjacent abrasive composites are rotated about 45 degrees from one another. In another embodiment, the adjacent abrasive composites are mirror images of each other. It is also possible for all of the abrasive composites to be identically shaped and oriented. Constructions are also possible in which the composites have different shapes and different orientations.

The base of the abrasive composites may abut one another or alternatively, the bases of adjacent abrasive composites may be separated from one another by some specified distance. In some embodiments, the physical contact between adjacent abrasive composites involves no more than 33% of the vertical height dimension of each contacting composite. The amount of physical contact between the abutting composites may be in the range of about 1 to about 25% of the vertical height of each contacting composite. The term "abutting" also covers an arrangement where adjacent composites share a common abrasive material land or bridge-like structure which contacts and extends between facing sidewalls of the composites. The land structure may have a height of no greater than 33% of the vertical height dimension of each adjacent composite. The abrasive material land is formed from the same slurry used to form the abrasive composites. The composites are "adjacent" in the sense that no intervening composite is located on a direct imaginary line drawn between the centers of the composites.

At least portions of the abrasive composites may be separated from one another so as to provide the recessed areas between the raised portions of the composites. The spacing of the abrasive composites may vary from about 1 abrasive composite per linear cm to about 200 abrasive composite per linear cm, for example between about 5 abrasive composite per linear cm to about 100 abrasive composite per linear cm. In addition, the spacing may be varied such that the concentration of composites is greater in one location than in another (e.g., the concentration may be greatest in the center of the surface). In some embodiments, there is an area spacing density of at least 1,200 composites/$cm^2$, said composites each comprising a plurality of abrasive particles and a binder. In a further embodiment of the invention, the area spacing density of composites ranges from about 1 to about 12,000 composites/$cm^2$, for example at least about 50 to about 8,000 abrasive composites/$cm^2$.

It is also feasible to have areas of the backing exposed, i.e., where the abrasive layer does not cover the entire surface area of the backing. This type of arrangement is further reported in U.S. Pat. No. 5,014,468 (Ravipati et al.) incorporated herein by reference.

The abrasive composites may be provided in a predetermined pattern. That is, the composites are provided at predetermined locations. For example, in the abrasive article made by providing a slurry between the backing and a production tool having cavities therein, the predetermined pattern of the composites will correspond to the pattern of the cavities on the production tool. The pattern is thus reproducible from article to article.

In one embodiment of the predetermined pattern, the abrasive composites are in an array or arrangement, by which is meant that the composites are in a regular array such as aligned rows and columns, or alternating offset rows and columns. In some instances, the one row of abrasive composites are directly aligned in front of a second row of abrasive composites. Alternatively, one row of abrasive composites is offset from the second row of abrasive composites. Adjacent rows of abrasive composites may be offset from one another.

Alternatively, the composites are deployed in a "random" array or configuration. By this it is meant that the composites are not in a regular array of rows and columns as described above. A "random" array is a predetermined pattern in that the location of the composites on the abrasive article is predetermined and corresponds to the location of the cavities in the production tool used to make the abrasive article.

The abrasive article also may have a variable abrasive layer composition. For example, the center of a fixed abrasive disc may contain an abrasive layer that is different (e.g., "softer, harder, or more or less erodible) from the outer region of the abrasive disc.

Supersize Coating

A supersize coating may be applied over the abrasive layer using conventional techniques such as roll coating, spray coating, hot melt coating, and the like. The supersize coating may typically comprise a loading-resistant material such as metal salts of fatty acids (e.g., zinc stearate, aluminum stearate, calcium stearate, or lithium stearate), graphite, waxes, glycol ethers, glycerine, silicone compounds, crosslinked alkoxy silanes, polycarbamates and the like.

Method of Manufacture

One method of providing a three-dimensional, textured, fixed abrasive article is generally as follows. A slurry comprising a mixture of a binder precursor and a plurality of abrasive grains is applied onto a production tool. The production tool has cavities that are the negative of the desired shape of the textured surface. A backing is brought into contact with the exposed surface of the production tool such that the slurry wets the surface of the backing. Then, the binder is at least partially solidified, cured, or gelled by exposure to ultraviolet light. The binder may be exposed to ultraviolet light for about 1 second to about 20 seconds, for example from about 1 second to about 10 seconds. In some embodiments, no additional heat is necessary, as the heat from the reaction and the light source may be sufficient to activate the thermal initiator. In other embodiments, the abrasive article is then removed from the production tool and fully cured by exposure to heat. The abrasive article is generally exposed to a temperature appropriate for the half-life of the chosen thermal initiator. In some embodiments, the temperature may be higher than 40° C., and some embodiments in excess of 70° C. The abrasive article is exposed to the heat for a time appropriate for the thermal initiator half-life, for example one hour at 100° C. Alternatively, the slurry is applied onto the surface of the backing and then the production tool is brought into contact with the slurry on the backing. The abrasive layer thus comprises a plurality of abrasive "composites" on a backing.

Three-dimensional abrasives benefit from removal from the tool as soon as possible. Therefore, it is advantageous to partially cure the binder and then remove the article before final cure.

Method of Use

The present invention may be used to abrade any workpiece. A method of abrading a surface of a workpiece using the present invention comprises bringing the surface of the workpiece and the abrasive article of the invention into frictional contact, and relatively moving the wafer and the fixed abrasive article to modify said surface of the workpiece. Particularly, the present invention may be used to abrade primed metal surfaces, or primed and painted metal surfaces, such as those used in the automotive paint industry. The abrasive article of this invention may also be used to abrade a glass, ceramic, and combination surfaces such as semiconductor wafers.

In some uses, the present invention may be used to abrade a workpiece in a liquid atmosphere. The liquid may be a reactive liquid, such as a working liquid for chemical mechanical planarization of semiconductor wafers, or aqueous solution. Aqueous solution is used in embodiments having the water soluble additive fillers incorporated into the abrasive article.

The invention will be more fully appreciated with reference to the following non-limiting examples. All weights described are in weight percents based on the total weight of the composition.

EXAMPLES

TABLE OF CONTENTS

| | |
|---|---|
| A174 | 3-methacryloxypropyl trimethoxy silane commercially available from Witco Corp. Friendly, WV under the trade designation "Silane A-174". |
| SR 295 | Pentaerythritol Tetraacrylate, commercially available from Satomer Company, Exton, PA, under the trade designation "SR295". |
| SR 339 | 2-phenoxyethyl acrylate, commercially available from Sartomer Company, Exton, PA, under the trade designation "SR339". |
| SR 351 | trimethylol propane triacrylate, commercially available from Sartomer Corp, Westchester, PA under the trade designation "SR351". |
| Dow 7 | Trifluoropropyl siloxane antifoamer, commercially available from Dow Corning Company, Midland, MI, under the trade designation "7". |
| GC3000 | Silicon carbide mineral (available from Fujimi Corporation, Nagoya, Japan under the trade name Microgrit GC3000 |
| Irgacure819 | Phosphine oxide, phenylbis (2,4,6-trimethyl benzoyl)-, commercially available from Ciba Specialty Chemicals Corporation, USA, Tarrytown, NY, under the trade designation "Irgacure 819". |
| Opaline ceria | Cerium oxide, commercially available from Rhodia Electronics and Catalysis, Shelton, CT, under the trade designation "Polishing Opaline". |
| PD9000 | An anionic polyester surfactant (dispersant), commercially available from ICI Americas, Inc. Wilmington, DE, under the trade designation "PD9000". |
| PVA | Polyvinyl alcohol, commercially available from Air Products, Allentown, PA, under the trade designation "Airvol 203S". The powders were screened down to −140 mesh size. |
| Solsperse | Solsperse 32000 dispersant (available from Avecia, Inc., Wilmington, DE. |
| TPO-L | Photoinitiator LR8893 Also known as Lucirin TPO-L, available from BASF Corp., Ludwigshafen, Germany. |
| Vazo52 | 2,2'-azobis(2,4-dimethylvaleronitrile), commercially available from DuPont, Wilmington, DE, under the trade designation "Vazo 52". |

Production Tool

An array of pyramids was formed by machining three sets of intersecting grooves on a workpiece using the techniques outlined in U.S. Pat. No. 5,672,097 to Hoopman ("Hoopman"). The first set of grooves were 63.5 μm deep and were machined with a 60.26 degree tool mounted with its centerline perpendicular to the workpiece with a pitch spacing of 72.94 μm. The second set of grooves was machined at 69 degrees to the first set of grooves with the same diamond tool again with a depth of 63.5 μm and a pitch spacing of 72.94 μm. The third set of grooves was machined with an 88.67 degree diamond tool mounted with its centerline perpendicular to the surface of the work piece. The third set of groove was cut 63.5 μm deep in a direction 55.5 degrees to the second set of groves through the intersections of the first and second sets of grooves. The pitch spacing of the third set of groove was 130 μm.

The master surface resulting from the machining process was electroformed to produce nickel replicas, which were then used to produce an embossing roll and eventually were used to produce the polypropylene production tool as outlined in Hoopman.

Manufacture of Abrasive Articles

The slurries were remixed by hand with a tongue depressor prior to coating. They were then poured by hand behind a knife coating head operating at a one mil gap with a coating width of ca. 8 inch on to 16 inch wide of the polypropylene tooling (described above), which was running at 30 ft/min. The slurry-wet tooling was then laminated with nip rolls set at 40 psi (16" roll faces) to a 3 mil ethylene acrylic acid co-polymer primed polyester web and run under a set of "D" bulbs (Fusion UV Systems, Inc. of Gaithersburg, Md.) at 600 W per inch while in contact with a 60° C. heated roll. The tooling was stripped from the cured slurry (which was now adhered to the polyester backing), and wound on to a take-up roll. Example 1 was additionally taken off the roll, held in an oven at 100° C. for 1 hour to assure total cure, and laminated by hand to Fasson E8 PSA tape (available from Avery Dennison Corp. of Framingham, Mass.). Discs (1¼" Dia) were punched out on a Hytronic press for testing.

Testing Procedure

Three tests were conducted, each of them counting the number of spots buffed into a painted panel. The painted panels, designated A and B, were obtained from ACT Laboratories, Hillsdale, Ill. Panel A is a steel panel primed with 764-204, then painted with 542AB921 black, and overcoated with RK8010A clear. Panel B is a steel panel primed with U28RW035K, painted with EA6KE524S black, and overcoated with E126CE012 clear. Test 1 used painted panel A and Test 2 used painted panel B; both tests are performed by hand (different operators), using a Dynorbital sander running at 7500 rpm; (available from Dynabrade Corp., Lawrence, N.Y.). The sanding procedure is to a) mount a disc on the pad of the sander, b) lightly mist the mounted disc with deionized water using a spray bottle, c) lightly rest the disk on the paint panel with as little pressure as possible other than the weight of the sander, and d) activate the sander for about 3 seconds. The disc is re-misted with the deionized water spray, and the process is repeated on a clean section of the paint panel. The testing is continued until there is no evidence of sanding activity by the disc. The panel is then wiped clean and the number of "well buffed" spots is estimated. Test 3 is a semi-robotic random orbital test running at 3200 rpm. It uses the same paint panel as Test 1, except that the panel is cut into strips 1⅞" wide for mounting on the machine. The test differs from the hand tests in that the machine presses the disc against the paint panel with a 40 g load, and in that the panel is pre-wet with a misting spray bottle. The numbers in Test 1 represent the average of three discs/lot, showing the number of spots effectively scuffed. (Note that the averages are not always in fractions of ⅓ because individual disc tests were subjectively rated as fractions of a spot—the "2.5" reported in the table for Lot 2 was the average of "2.0, 2.3, and 3.2" readings recorded). The numbers of Test 2 represent only one disc/lot were tested; with the variability of this test thus considerably higher. The numbers of Test 3 represent the average of four discs/lot.

Control Example

The Control Example was a commercially available abrasive article, Trizact Finesse-it 466L (commercially available from Minnesota Mining and Manufacturing Co., St. Paul, Minn.).

Abrasive Articles

Experimental lots were prepared as shown below. The experimental samples were prepared as 400 g batches, using the amounts in Table 1 below:

TABLE 1

| | Example | | |
|---|---|---|---|
| Ingredient | Ex. 1 Grams | Comp. Ex. A Grams | Comp. Ex. B Grams |
| SR351 | 88.38 | 77.88 | 89.36 |
| SR339 | 58.93 | 51.76 | 59.58 |
| Solsperse 32000 | 1.23 | 0 | 1.22 |
| PD9000 | 0 | 12.32 | 0 |
| A174 | 0 | 7.72 | 0 |
| TPO-L | 4.91 | 4.32 | 4.96 |
| GC3000 | 245.07 | 246.00 | 244.88 |
| Vazo 52 | 1.47 | 0 | 0 |
| Total Weight | 400 | 400 | 400 |

Example 1

Trimethylol propane triacrylate and the 2-phenoxy ethyl acrylate (available from Sartomer Corp, Westchester, Pa. under the trade names of SR351 and SR339 respectively) were weighed into a 400 ml polyethylene container with a dispersant. The container was placed in a hot air oven set at 60° C. and allowed to heat until the dispersant had melted and dissolved into the acrylate mixture. The container was then removed from the oven and allowed to cool to room temperature. A silane coupling agent, 3-methacryloxypropyl trimethoxy silane (available from Witco Corp, Friendly, W.Va. under the trade name "Silane A-174") was added, followed by the photoinitiator LR8893 (Also known as Lucirin TPO-L, available from BASF Corp., Ludwigshafen, Germany). The components were mixed for about 5 minutes using an air stirrer (Gast Mfg. Inc., Benton Harbor, Mich.) with a high-shear style mixing blade. The silicon carbide mineral (available from Fujimi Corporation, Nagoya, Japan under the trade name Microgrit GC3000) was pre-weighed into a separate container and then added to the binder precursor blend while stirring the binder precursor at high speed. Once the mineral was completely added, the stirrer was stopped, and any mineral adhering to the stirrer or the container sides was mixed into the blend with a tongue depressor. The mixer was again started, and the slurry was stirred until smooth (ca. 5 min.). The thermal initiator (Vazo 52) was prepulverized with a mortar and pestle, and then weighed into the container. The powder was stirred in by hand with a tongue depressor until dissolved; the container was then capped and stored until coating.

Comparative Example A and Comparative Example B

All procedures were similar to Example 1 with the exception of the addition of the Vazo 52. The acrylates were again weighed into the container with a dispersant. The same procedure for dissolving the surfactant and adding the photoinitiator were followed. Likewise, the mineral was weighed out and added following the procedure outlined in Example 1. The container was taken out from under the mixer and allowed to cool to room temperature. Comparative Examples A and B was capped and stored until coating at this point.

Example 1, the Control Example and Comparative Examples A and B were tested according to the Testing Procesdure outlined above. Test results are shown in Table 2 below expressed as a percentage of the values obtained with the Control Example tested at the same time.

TABLE 2

| Example | Test 1 | Test 2 | Test 3 |
|---|---|---|---|
| Control | 100 | 100 | 100 |
| Example 1 | 121 | 275 | 92 |
| Comp. Ex. A | 129 | 50 | 92 |
| Comp. Ex. B | 106 | 950 | 62 |

The results, taken as a whole, indicate that the thermally-initiated material does not suffer any in performance relative to material without thermal initiator.

Examples 2–7

Slurry preparation procedures were as described in Example 1, except that fine granulated sugar (available as "Bakers" grade granulated sugar) or dextrin (available from the A. E. Staley Manufacturing Corp., Decatur, Ill. under the trade name of Stadex 230) was added as shown in Table 3. All coating and converting procedures were as described in Example 1. The Examples were randomized and tested "blind" using the testing procedure of Test 1 with three discs/lot. The data is tabulated and shown in Table 4 (expressed as a percentage of the values obtained with a Control Example tested at the same time.)

TABLE 3

| | Example | | | | | |
|---|---|---|---|---|---|---|
| Ingredient | Ex. 2 Grams | Ex. 3 Grams | Ex. 4 Grams | Ex. 5 Grams | Ex. 6 Grams | Ex. 7 Grams |
| SR351 | 80.33 | 72.48 | 76.60 | 80.33 | 76.60 | 80.24 |
| SR339 | 53.56 | 48.32 | 51.07 | 53.56 | 51.07 | 53.50 |
| Solsperse 32000 | 1.21 | 1.19 | 1.20 | 1.21 | 1.20 | 1.21 |
| PD9000 | 0 | 0 | 0 | 0 | 0 | 0 |
| A174 Silane | 0 | 0 | 0 | 0 | 0 | 0 |
| TPO-L | 4.46 | 4.02 | 4.25 | 4.46 | 4.25 | 4.45 |
| GC3000 | 241.90 | 238.76 | 240.32 | 241.90 | 240.32 | 242.04 |
| D111 Surfactant | 0.25 | 0.50 | 0.38 | 0.25 | 0.38 | 0.25 |
| Sugar | 16.96 | 33.50 | 25.28 | 16.96 | 25.28 | |
| Dextrin | 0 | 0 | 0 | 0 | 0 | 16.96 |
| Vazo 52 | 1.34 | 1.21 | 1.28 | 1.34 | 1.28 | 1.34 |
| Total Weight | 400 | 400 | 400 | 400 | 400 | 400 |

TABLE 4

| Example | Test 1 |
|---|---|
| Control | 100 |
| Comp. Ex. A (2nd Batch) | 106.7 |
| Ex. 2 | 86.6 |
| Ex. 3 | 226.6 |

TABLE 4-continued

| Example | Test 1 |
|---|---|
| Ex. 4 | 93.4 |
| Ex. 5 | 140.0 |
| Ex. 6 | 100.0 |
| Ex. 7 | 120.0 |

Examples 8–11

Slurry preparation procedures were as described in Example 1, except that fine confectioners sugar, C&H Sugar Company, Inc., Crockett, Calif. was added as shown in Table 5 and an additional dispersant, Disperbyk 111 (Available from Byk-Chemie, Wallingford, Conn.) was added. All coating and converting procedures were as described in Example 1.

The Examples were tested according to the Testing Procedure outlined above. Test results are shown in Table 6 (expressed as a percentage of the values obtained with a Control Example tested at the same time).

TABLE 5

| | Example | | | |
|---|---|---|---|---|
| Ingredient | Ex. 8 Grams | Ex. 9 Grams | Ex. 10 Grams | Ex. 11 Grams |
| SR351 | 80.33 | 85.93 | 92.40 | 64.84 |
| SR339 | 53.56 | 57.29 | 61.60 | 43.23 |
| Solsperse 32000 | 1.21 | 1.02 | 0.80 | 1.18 |
| PD9000 | 0 | 0 | 0 | 0 |
| A174 | 0 | 0 | 0 | 0 |
| D111 | 0.25 | 0.68 | 1.17 | 0.74 |
| TPO-L | 4.46 | 4.77 | 5.13 | 3.60 |
| Sugar | 16.96 | 45.40 | 78.16 | 49.60 |
| GC3000 | 241.90 | 203.46 | 159.20 | 235.74 |
| Vazo 52 | 1.34 | 1.43 | 1.54 | 1.08 |
| Total Weight | 400.01 | 399.98 | 400.00 | 400.01 |

TABLE 6

| Example | Test 1 | Test 2 | Test 3 |
|---|---|---|---|
| Control | 100 | 100 | 100 |
| Comp. Ex. A | 38.9 | 57.1 | 104 |
| Ex. 8 | 161.4 | 107.1 | 76 |
| Ex. 9 | 36.1 | 242.9 | 60 |
| Ex. 10 | 41.7 | N/A | 40 |
| Ex. 11 | 152.8 | 342.9 | 68 |

Example 12

An abrasive article was formulated as described in Table 7 and prepared generally as described above. The formulation was coated on a production tool similar to Pattern 1, but with dimensions selected to give a pyramid height of 355 micrometers. The line speed was about 1.8 meter per minute (6 feet per minute) and "V" type UV bulb was used. The mandrel temperature was maintained at 80° C. No additional post cure was necessary, as the heat from the UV bulbs, coupled with the heat from the exothermic photoinitiation reaction and the heat from the mandrel was sufficient to activate the thermal initiator and completely cure the abrasive article.

TABLE 7

| Ingredient | Weight, gm | Density, g/cc | Wt. % | Vol. cc | Vol. % |
|---|---|---|---|---|---|
| SR 295 | 2721.2 | 1.18 | 8.48 | 30 | 19.53 |
| SR 339 | 2721.2 | 1.10 | 8.48 | 32 | 20.88 |
| PD9000 | 423.5 | 1.15 | 1.32 | 5 | 3.11 |
| Dow 7 | 177.1 | 0.81 | 0.55 | 3 | 1.85 |
| Irgacure 819 | 154.0 | 1.11 | 0.48 | 2 | 1.17 |
| Opaline ceria | 21573.9 | 7.30 | 67.21 | 38 | 25.01 |
| PVA | 4269.7 | 1.29 | 13.30 | 43 | 28.01 |
| Vazo 52 | 57.0 | 1.10 | 0.18 | 1 | 0.44 |
| Total (gm) | 32097 | | 100 | 153 | 100 |

A small sheet ceria pad sample with a diameter of 20.3 cm (8 inches) was cut out of the roll produced on the Pilot line and the polishing rate was determined using a single side polisher manufactured by R. Howard Strasbaugh, Inc, Long beach, Calif., model number 6Y-1. The sheet of pressure sensitive adhesive was glued to the back of the ceria pad and placed tight on the bottom plate of the machine. A glass sheet (65 mm diameter and 1 mm thick, from Nippon Sheet Glass, Japan) was placed under the sample holder that is mounted to the top plate. The top and bottom speeds of the platten are 50 and 80 rpm, respectively. The deionized water was used as coolant with a flow rate of 30 cc/min. The weight loss of the glass disks was measured every 5 minutes and continued up to 30 minutes from which the cut rate ($\mu$m/min) was calculated. Cut rate was measured at specific times, as shown in Table 8.

TABLE 8

| Polishing Time (Minutes) | Cut Rate (micrometers/minute) |
|---|---|
| 5 | 0.302 |
| 10 | 0.514 |
| 15 | 0.522 |
| 20 | 0.505 |
| 25 | 0.505 |
| 30 | 0.505 |

This data shows that the abrasive article of Ex. 2 is a functional abrasive article.

Cure Test

The degree of cure was tested by Tetrahydrofuran (THF) Soxhlet Extraction. The process required a Whatman cellulose extraction thimbles, 35 mm×80 mm, to be weighed and identified for each sample. A sample (between 5 and 6.5 grams) of the abrasive article to be tested was then cut out and placed in thimble. The thimble containing the sample was then reweighed. The sample is then conditioned at 38° C. for 2 hours in an air circulating oven to remove excess surface moisture. Each sample is then extracted for 24 hours using a continuous Soxhlet extraction apparatus and using 200 ml of THF. After extraction, the thimble containing the extracted sample is removed from the extraction apparatus and conditioned at 68° C. overnight (about 12 hours). Then the thimbles containing the samples are placed in a desiccator for 15 minutes, or until cool, and reweighed to calculate weigh loss (percent extractables).

Following the above procedure, the Comp. Ex. A had a weight loss of 2.38%. Example 1 was then tested before thermal cure and had a weight loss of 2.75% (equal to control within error). Example 1 was additionally tested after thermal cure and had a weight loss of 0.73%. This weight loss indicated that Example 1 contained fewer extractables and that the thermal initiator had further cured the sample.

Various modifications and alterations of this invention will become apparent to those skilled in the art without departing from the scope and spirit of this invention. It should be understood that this invention is not to be unduly limited to the illustrated embodiments shown herein.

What is claimed is:

1. A method of making a three-dimensional fixed abrasive article comprising:

(a) providing an abrasive composition comprising a plurality of abrasive particles and a binder precursor, the binder precursor comprising a polymerizable material consisting essentially of an ethylenically unsaturated material having one or more terminal functional groups of the same type of reactive functionality, a photoinitiator for the reactive functionality, and a thermal initiator for the reactive functionality;

(b) applying the abrasive composition onto a backing;

(c) at least partially curing the binder precursor by activating the photoinitiator; and (d) further curing the binder precursor by activating the thermal initiator, to provide a three-dimensional fixed abrasive.

2. The method of claim 1 wherein after (a) the abrasive composition is placed in a production tool.

3. The method of claim 2 wherein during the process of (c) the abrasive composition is in the production tool.

4. The method of claim 2 wherein before (d) the abrasive composition is removed from the production tool.

5. The method of claim 1 wherein the polymerizable material is a (meth)acrylate.

6. The method of claim 1 wherein at (c) the photoinitiator is activated by exsposing the abrasive composition to a source of ultraviolet light.

7. The method of claim 6 wherein at (c) the abrasive composition is exposed to the ultraviolet light for about 1 to about 10 seconds.

8. The method of chaim 1 wherein at (d) the thermal initiator is activated by exposing the abrasive composition to heat.

9. The method of claim 1 wherein the abrasive composition further comprises water soluble particles.

10. The method of claim 1 wherein the abrasive composition further comprises water swellable particles.

* * * * *

UNITED STATES PATENT AND TRADEMARK OFFICE

CERTIFICATE OF CORRECTION

PATENT NO. : 6,848,986 B2
DATED : February 1, 2005
INVENTOR(S) : Kendall, Philip E.

It is certified that error appears in the above-identified patent and that said Letters Patent is hereby corrected as shown below:

Column 3,
Line 32, delete “credibility” and insert -- erodibility --, therefor.

Column 8,
Line 30, after “and” delete “,”.

Column 20,
Line 9, delete “exsposing” and insert -- exposing --, therefor.
Line 14, delete “chaim 1” and insert -- claim 1 --, therefor.

Signed and Sealed this

Twenty-fourth Day of May, 2005

JON W. DUDAS
*Director of the United States Patent and Trademark Office*